US011459516B2

(12) United States Patent
Hodgkins et al.

(10) Patent No.: US 11,459,516 B2
(45) Date of Patent: Oct. 4, 2022

(54) TWO STAGE HYDRODEARYLATION SYSTEMS TO CONVERT HEAVY AROMATICS INTO GASOLINE BLENDING COMPONENTS AND CHEMICAL GRADE AROMATICS

(71) Applicant: Saudi Arabian Oil Company, Dhahran (SA)

(72) Inventors: Robert Peter Hodgkins, Dhahran (SA); Omer Refa Koseoglu, Dhahran (SA); Frederick Adam, Dhahran (SA)

(73) Assignee: SAUDI ARABIAN OIL COMPANY

( * ) Notice: Subject to any disclaimer, the term of this patent is extended or adjusted under 35 U.S.C. 154(b) by 3 days.

(21) Appl. No.: 17/328,580

(22) Filed: May 24, 2021

(65) Prior Publication Data

US 2021/0277317 A1 Sep. 9, 2021

Related U.S. Application Data

(62) Division of application No. 16/592,591, filed on Oct. 3, 2019, now Pat. No. 11,046,899.

(51) Int. Cl.

| | |
|---|---|
| ***C10G 65/12*** | (2006.01) |
| ***C10G 69/08*** | (2006.01) |
| ***C10G 35/06*** | (2006.01) |

(52) U.S. Cl.

CPC ..... *C10G 65/12* (2013.01); *C10G 35/065* (2013.01); *C10G 69/08* (2013.01); (Continued)

(58) Field of Classification Search

None

See application file for complete search history.

(56) References Cited

U.S. PATENT DOCUMENTS 2,373,501 A 4/1945 Dewey
3,132,086 A 5/1964 Kelley et al.
(Continued)

FOREIGN PATENT DOCUMENTS

CN 1566282 A 1/2005
CN 1613557 A 5/2005
(Continued)

OTHER PUBLICATIONS

International Search Report and Written Opinion for PCT Application No. PCT/US2020/053949 dated Jan. 20, 2021.

*Primary Examiner* — Tam M Nguyen
(74) *Attorney, Agent, or Firm* — Bracewell LLP; Constance Gall Rhebergen

(57) ABSTRACT

Systems and methods include an aromatics complex (ARC), the ARC in fluid communication with a naphtha reforming unit (NREF) and operable to receive a reformate stream produced by the NREF, and the ARC further operable to separate the reformate stream into a gasoline pool stream, an aromatics stream, and an aromatic bottoms stream; and a hydrodearylation unit operable to receive heavy, non-condensed, alkyl-bridged, multi-aromatic compounds from the aromatic bottoms stream, the hydrodearylation unit further operable to hydrogenate and hydrocrack the heavy, non-condensed, alkyl-bridged, multi-aromatic compounds to produce a stream suitable for recycle to the NREF or the reformate stream, where the hydrodearylation unit is further operable to receive hydrogen produced in the NREF.

21 Claims, 7 Drawing Sheets

(52) U.S. Cl.
CPC ..... *C10G 2300/1044* (2013.01); *C10G 2300/4081* (2013.01); *C10G 2300/70* (2013.01); *C10G 2400/04* (2013.01); *C10G 2400/08* (2013.01); *C10G 2400/30* (2013.01)

(56) References Cited

U.S. PATENT DOCUMENTS

| | | | |
|---|---|---|---|
| 5,189,233 | A | 2/1993 | Larkin et al. |
| 5,210,333 | A | 5/1993 | Bellows et al. |
| 5,235,120 | A | 8/1993 | Bogdan et al. |
| 5,294,334 | A | 3/1994 | Kaul et al. |
| 5,773,670 | A | 6/1998 | Gildert et al. |
| 5,830,345 | A | 11/1998 | Lee et al. |
| 5,856,602 | A | 1/1999 | Gildert et al. |
| 6,187,980 | B1 | 2/2001 | Gildert et al. |
| 8,395,006 | B2 | 3/2013 | Clark et al. |
| 8,936,715 | B2 | 1/2015 | Noh et al. |
| 9,109,169 | B2 | 8/2015 | Al-Therwi et al. |
| 9,315,742 | B2 | 4/2016 | Aubry et al. |
| 9,334,451 | B2 | 5/2016 | Koseoglu et al. |
| 9,528,052 | B2 | 12/2016 | Smegal et al. |
| 9,856,425 | B2 | 1/2018 | Ward et al. |
| 10,035,140 | B2 | 7/2018 | Al-Khattaf et al. |
| 10,053,401 | B1 | 8/2018 | Beadle et al. |
| 10,093,873 | B2 | 10/2018 | Koseoglu et al. |
| 2008/0194900 | A1 | 8/2008 | Bhirud |
| 2013/0184506 | A1 | 7/2013 | Yanagawa et al. |
| 2013/0193034 | A1 | 8/2013 | Bourane et al. |
| 2015/0337208 | A1 | 11/2015 | Litz et al. |
| 2016/0115402 | A1* | 4/2016 | Xu ..... C10G 47/02 208/60 |
| 2016/0137933 | A1 | 5/2016 | Ward et al. |
| 2016/0362618 | A1 | 12/2016 | Oprins et al. |
| 2016/0369187 | A1 | 12/2016 | Ward et al. |
| 2016/0369188 | A1 | 12/2016 | Housmans et al. |
| 2016/0369191 | A1 | 12/2016 | Ward et al. |
| 2017/0009157 | A1 | 1/2017 | Oprins |
| 2017/0058214 | A1 | 3/2017 | Oprins et al. |
| 2017/0158969 | A1 | 6/2017 | Dath et al. |
| 2018/0066197 | A1* | 3/2018 | Koseoglu ..... C10G 69/08 |
| 2018/0282638 | A1 | 10/2018 | Aramburo et al. |
| 2019/0048270 | A1 | 2/2019 | Vannauker et al. |
| 2019/0055483 | A1 | 2/2019 | Bafna et al. |
| 2019/0241486 | A1* | 8/2019 | Koseoglu ..... C07C 4/24 |
| 2020/0062675 | A1* | 2/2020 | Koseoglu ..... C07C 4/18 |
| 2020/0283355 | A1* | 9/2020 | Koseoglu ..... C07C 6/126 |
| 2021/0253959 | A1* | 8/2021 | Koseoglu ..... C10G 65/043 |
| 2021/0253962 | A1* | 8/2021 | Hodgkins ..... C10G 47/30 |
| 2021/0261869 | A1* | 8/2021 | Koseoglu ..... C10G 11/18 |
| 2021/0269724 | A1* | 9/2021 | Hodgkins ..... C10G 45/44 |
| 2022/0220397 | A1* | 7/2022 | Koseoglu ..... B01J 19/245 |

FOREIGN PATENT DOCUMENTS

| | | | |
|---|---|---|---|
| JP | H11349960 | A | 12/1999 |
| WO | 2017093056 | A1 | 6/2017 |
| WO | 2018011642 | A1 | 1/2018 |

* cited by examiner

TWO STAGE HYDRODEARYLATION SYSTEMS TO CONVERT HEAVY AROMATICS INTO GASOLINE BLENDING COMPONENTS AND CHEMICAL GRADE AROMATICS

PRIORITY

This application is a non-provisional divisional application of and claims priority to and the benefit of U.S. application Ser. No. 16/592,591, filed on Oct. 3, 2019, now U.S. Pat. No. 11,046,899, the entire disclosure of which is incorporated here by reference.

BACKGROUND

Field

Embodiments of the disclosure relate to separation systems and processes for hydrocarbon fluids. In particular, certain embodiments of the disclosure relate to systems and processes for catalytic hydrodearylation and aromatics recovery, for example, converting heavy alkylated aromatics to produce gasoline blending components such as paraffins, xylenes, and ethyl benzene.

Description of the Related Art

Catalytic reformers are used in refineries to produce reformate, which itself is used as an aromatic rich gasoline blending fraction, or is used as feedstock to produce aromatics, also referred to as benzene, toluene, and xylene (BTX). Due to stringent fuel specifications implemented or being implemented worldwide, for example requiring less than 35 volume % (V %) aromatics and less than 1 V % benzene in gasoline, the reformate fraction is further treated to reduce its aromatics content. Treatment options available include benzene hydrogenation and aromatics extraction. In benzene hydrogenation, the reformate is selectively hydrogenated to reduce the benzene content, and the total aromatics content is reduced by blending if needed. In aromatics extraction, the reformate is sent to an aromatic complex to extract the aromatics, such as benzene, toluene and xylenes, which have a premium chemical value, and to produce an aromatics and benzene free gasoline blending component. The aromatics complex produces a reject stream or bottoms stream that is very heavy (boiling in the range of about 100-350° C. or 450° C.), which is not suitable as a gasoline blending component.

Refinery products used for fuels are receiving increasing levels of attention. Product specifications are being scrutinized by governmental agencies whose interests include decreased emissions from mobile and stationary sources, and by the industries that produce the engines and vehicles that utilize these fuels. Regional and national regulations have been in place and continue to evolve concerning gasoline specifications, and automakers have proposed a set of limitations for gasoline and diesel to allow them to manufacture vehicles that will produce significantly lesser emissions over their lifetime. Maximum sulfur, aromatics, and benzene levels of about 10 ppmw, 35 V %, and 1 V % or less, respectively, have been targeted as goals by regulators.

Historically, lead was commonly added to gasoline to increase octane count. When the use of lead was phased out due to environmental concerns, no direct substitute existed, and refiners instead have converted certain hydrocarbon molecules used in gasoline blending in order to achieve greater octane ratings. Catalytic reforming, which involves a variety of reactions in the presence of one or more catalysts and recycle and make-up hydrogen, is a widely used process for refining hydrocarbon mixtures to increase the yield of greater octane gasoline.

Although benzene yields can be as much as 10 V % in reformates, no more than about 3 V % can be present in typical gasoline pools. There currently exist methods to remove benzene from reformate, including separation processes and hydrogenation reaction processes. In separation processes, benzene is extracted with a solvent and then separated from the solvent in a membrane separation unit or other suitable unit operation. In hydrogenation reaction processes, the reformate is divided into fractions to concentrate the benzene, and then one or more benzene-rich fractions are hydrogenated. In some refineries, naphtha is reformed after hydrodesulfurization to increase the octane content of the gasoline. Reformate contains a greater level of benzene which must be reduced in order to meet requisite fuel specifications that are commonly in the range of from about 1-3 V % benzene, with certain geographic regions targeting a benzene content of less than 1 V %. Benzene hydrogenation is an established process that can be used to reduce the benzene content of the reformate product stream.

In catalytic reforming, a naphtha stream is first hydrotreated in a hydrotreating unit to produce a hydrotreated naphtha stream. A hydrotreating unit operates according to certain conditions, including temperature, pressure, hydrogen partial pressure, liquid hourly space velocity (LHSV), and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels.

Some gasoline blending pools include $C_4$ and heavier hydrocarbons having boiling points of less than about 205° C. In catalytic reforming process, paraffins and naphthenes are restructured to produce isomerized paraffins and aromatics of relatively greater octane numbers. Catalytic reforming converts lesser octane n-paraffins to i-paraffins and naphthenes. Naphthenes are converted to greater octane aromatics. The aromatics are left essentially unchanged, or some may be hydrogenated to form naphthenes due to reverse reactions taking place in the presence of hydrogen. The reactions involved in catalytic reforming are commonly grouped into the four categories of cracking, dehydrocyclization, dehydrogenation, and isomerization. A particular hydrocarbon/naphtha feed molecule may undergo more than one category of reaction and/or may form more than one product.

The catalysts for catalytic reforming processes are either mono-functional or bi-functional reforming catalysts, which contain precious metals, such as Group VIIIB metals, as active components. A bi-functional catalyst has both metal sites and acidic sites. Refineries generally use a platinum catalyst or platinum alloy supported on alumina as the reforming catalyst. The hydrocarbon/naphtha feed composition, the impurities present therein, and the desired products will determine such process parameters as choice of catalyst(s), process type, and the like. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

Reformate is usually sent to an aromatics recovery complex (ARC) where it undergoes several processing steps in order to recover greater value products, for example xylenes and benzene, and to convert less valuable products, for example toluene, into greater value products. For example, the aromatics present in reformate are usually separated into different fractions by carbon number; such as benzene, toluene, xylenes, and ethylbenzene, etc. The $C_8$ fraction is then subjected to a processing scheme to make more valuable para-xylene. Para-xylene is usually recovered in greater purity from the $C_8$ fraction by separating the para-xylene from the ortho-xylene, meta-xylene, and ethylbenzene using selective adsorption or crystallization. The ortho-xylene and meta-xylene remaining from the para-xylene separation are isomerized to produce an equilibrium mixture of xylenes. The ethylbenzene is isomerized into xylenes or is dealkylated to benzene and ethane. The para-xylene is then separated from the ortho-xylene and the meta-xylene using adsorption or crystallization and the para-xylene-depleted-stream is recycled to extinction to the isomerization unit and then to the para-xylene recovery unit until all of the ortho-xylene and meta-xylene are converted to para-xylene and recovered.

Toluene is recovered as a separate fraction, and then may be converted into greater value products, for example benzene in addition to or alternative to xylenes. One toluene conversion process involves the disproportionation of toluene to make benzene and xylenes. Another process involves the hydrodealkylation of toluene to make benzene. Both toluene disproportionation and toluene hydrodealkylation result in the formation of benzene. With the current and future anticipated environmental regulations involving benzene, it is desirable that the toluene conversion not result in the formation of significant quantities of benzene.

One problem faced by refineries is how to most economically reduce the benzene content in the reformate products sent to the gasoline pool by improving the processes and apparatus of systems described above. In some refineries, the aromatic complex bottoms are added to the gasoline fraction. However, the aromatic complex bottoms deteriorate gasoline quality and impact combustion engine performance negatively. Single ring aromatic hydrogenation to a corresponding cyclohexane is a known process. For example, hydrogenation of aromatics can occur in a petroleum stream. Hydrogenation of benzene to cyclohexane in a distillation column reactor where the feedstock is essentially pure benzene can also occur. Processes exist that selectively adsorb benzene from a gasoline stream and thereafter hydrogenate the benzene into cyclohexane without the need for added desorbents. A serious drawback of hydrogenation technology is the significant reduction of octane number, because the octane rating of cyclohexane is less than that of benzene.

Hydrodearylation refers to processes for cleaving of the alkyl bridge of non-condensed, alkyl-bridged multi-aromatics or heavy alkyl aromatic compounds to form alkyl mono-aromatics, in the presence of a catalyst and hydrogen. The aromatic bottoms stream from a xylene rerun column of an aromatic complex is limited as a gasoline blending component because of its dark color, greater density, and greater boiling point.

SUMMARY

Applicant has recognized a need for catalytic hydrodearylation and aromatics recovery systems and processes, particularly for converting heavy alkylated aromatics to produce gasoline blending components, paraffins, xylenes, and ethyl benzenes. In some embodiments, one or more bleed stream containing a greater concentration of naphthenes and a lesser concentration of aromatics can be directed as blending components suitable for diesel and jet fuel.

Embodiments of the disclosure allow for processing an aromatic bottoms stream within an existing refinery to improve its quality, for example, for gasoline blending. An aromatic bottoms stream can be sent directly to a two-stage hydrodearylation (hydrogenation and light hydrocracking) unit, or can be first fractionated to then process with hydrogenation and light hydrocracking only the heavy (180° C.+ boiling point) fraction to convert non-condensed, alkyl-bridged multi-aromatics (for example, including di-aromatics) to mono-aromatics for use as gasoline blending components and for use in benzene, toluene, and xylene (BTX) production.

A less valuable aromatic bottoms stream from the aromatics complex is subjected to a two-stage hydrodearylation process (hydrogenation and lesser-pressure hydrocracking over a dual catalyst system, for example), whereby the liquid products produce a stream that is rich in mono-naphthenes, paraffins, and valuable BTX. Hydrodearylation allows for processing of this less valuable stream at relatively mild conditions to yield a greater composition of mono-aromatics and a lesser composition of di-aromatics. The final product is recycled back to a reforming unit as gasoline blending components to improve gasoline volume and quality. A portion or all of the final product can also be recycled back to a reformate stream. Alternatively, the mono-naphthenes product composition formed can be separated from the mono-aromatic and paraffin products as a bleed stream and directed elsewhere as a component suitable for diesel and jet fuel blending.

Significant improvements are shown for production of mono-aromatic $C_8$ products (xylenes and ethyl benzenes). Generally about 15 V % of reformate sent to an aromatics complex flows to the aromatic bottoms fraction. For example, assuming a 100 MBPD (thousand barrels per day) reformate capacity, 15 MBPD of less valuable aromatic bottoms will, with embodiments of the present disclosure, be converted to valuable gasoline blending components and xylenes and ethyl benzenes, a substantial gain for a refinery (See FIGS. 3A-3B).

Rerouting an aromatic bottoms stream to a two-stage hydrodearylation (hydrogenation and light hydrocracking) unit for the production of gasoline blending components improves gasoline volume and quality, as well as BTX production. In certain embodiments, a two-stage hydrodearylation process is carried out in the presence of two different catalysts; a noble metal catalyst and an acid catalyst. Embodiments disclosed here not only perform hydrodearylation, but also hydrogenate aromatics to give paraffins, olefins, and naphthenes. Ultimately, two-stage hydrodearylation converts heavy, non-condensed alkyl-bridged aromatics (such as di-aromatics) to improve gasoline volume and quality, while producing mono-naphthenes, paraffins, and BTX. Di-aromatics can be converted to mono-aromatics by two mechanisms: (i) hydrodearylation and (ii) hydrogenation of condensed di-aromatics such as naphthalene. The first mechanism is a carbon-carbon bond breaking step of breaking a carbon bridge to convert di-aromatics to mono-aromatics. The second mechanism includes partial hydrogenation of one ring in a di-aromatic molecule such as naphthalene, and cracking of the naphthenic bond is effected to dealkylate the molecule to produce mono-aromatics.

Hydrogenation processes can convert aromatic rich petroleum streams into naphthenes, which have good fuel properties, for example, smoke point for jet fuel and cetane number for diesel. Hydrogenation is generally performed over a non-noble metal catalyst, for example, Ni, Mo or combination thereof, or a noble metal catalyst, for example, Pt, Pd or combination thereof in the case of deep hydrogenation, at moderate hydrogen partial pressure. Noble base metal catalysts plus acidic catalysts such as zeolite-containing catalysts enhance hydrogen transfer reactions during alkyl-aromatic dealkylation.

Therefore, disclosed here is a system for oil separation and upgrading, the system including an inlet stream comprising crude oil; an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising diesel; a naphtha hydrotreating unit (NHT), the NHT in fluid communication with the ADU and operable to treat with hydrogen the naphtha in the ADU tops stream; a naphtha reforming unit (NREF), the NREF in fluid communication with the NHT and operable to reform a hydrotreated naphtha stream produced by the NHT, and the NREF further operable to produce separate hydrogen and reformate streams; an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream; and a hydrodearylation unit operable to receive heavy, non-condensed, alkyl-bridged, multi-aromatic compounds from the aromatic bottoms stream, the hydrodearylation unit further operable to hydrogenate and hydrocrack the heavy, non-condensed, alkyl-bridged, multi-aromatic compounds to produce a stream suitable for recycle to the NREF or the reformate stream, where the hydrodearylation unit is further operable to receive hydrogen produced in the NREF.

In some embodiments of the system, the hydrodearylation unit comprises a hydrogenation unit and a light hydrocracking unit, and the hydrogenation unit is operable to receive hydrogen produced in the NREF. In other embodiments of the system it includes a fractionator fluidly disposed between the ARC and the hydrodearylation unit, the fractionator operable to separate the heavy, non-condensed, alkyl-bridged, multi-aromatic compounds from the aromatic bottoms stream from compounds with a boiling point of about 180° C. or less. Still in other embodiments, the fractionator comprises an atmospheric distillation unit. In certain other embodiments, the aromatic bottoms stream comprises aromatic compounds with boiling points in a range of about 100° C. to about 450° C. In yet other embodiments, the stream suitable for recycle to the NREF or the reformate stream comprises at least one component selected from the group consisting of: mono-aromatics; naphthenic mono-aromatics; mono-naphthenics; di-naphthenics; paraffins; naphthenic di-aromatics; di-aromatics; tri-/tetra-aromatics; and combinations of the same. Still in other embodiments, the mono-aromatics comprise benzene, toluene, xylenes, and ethyl benzene.

In other embodiments of the system, the hydrodearylation unit produces a gas stream separate from the stream suitable for recycle to the NREF or the reformate stream, the gas stream comprising at least one component selected from the group consisting of: fuel gas, liquefied petroleum gas, ethylene, propylene, butylene, and combinations of the same. Still in other embodiments, the hydrodearylation unit is a dual catalyst hydrodearylation unit comprising at least 2 different catalysts. In certain other embodiments, at least one of the hydrogenation unit and light hydrocracking unit include a catalyst selected from the group consisting of: a noble metal, a non-noble metal, a zeolite, and a solid acid catalyst. Still in other embodiments, the hydrogenation unit includes a catalyst comprising platinum and the light hydrocracking unit includes a catalyst comprising ZSM-5 zeolite with an alumina-only binder and no active phase metals.

In certain other embodiments, the hydrogenation unit and light hydrocracking unit use different catalysts. In yet other embodiments, the heavy, non-condensed, alkyl-bridged, multi-aromatic compounds from the aromatic bottoms stream comprise at least two benzene rings connected by an alkyl bridge group having at least two carbons, and the benzene rings are connected to different carbons of the alkyl bridge group. Still in other embodiments, the hydrodearylation unit is operable at pressures between about 10 bar and about 100 bar. In certain embodiments, the hydrodearylation unit is operable at pressures between about 15 bar and about 70 bar. In other embodiments, the hydrodearylation unit is operable at temperatures between about 150° C. and about 450° C. Still in other embodiments, the hydrodearylation unit is operable at temperatures between about 200° C. and about 400° C. Still in other embodiments, the hydrodearylation unit produces a bleed stream containing naphthenes and aromatics to be directed towards fuel pools suitable for diesel and jet fuel. In certain embodiments, benzene content of the gasoline pool stream is less than about 3% by volume. In other embodiments of the system, benzene content of the gasoline pool stream is less than about 1% by volume. Still in other embodiments, a portion of the stream suitable for recycle to the NREF or the reformate stream is recycled to the fractionator.

Additionally disclosed is a method for oil separation and upgrading, the method including supplying an inlet stream comprising crude oil; separating the inlet stream into a tops stream and a middle stream, the tops stream comprising naphtha, and the middle stream comprising diesel; treating with hydrogen the naphtha in the tops stream to produce a hydrotreated naphtha stream; reforming the hydrotreated naphtha stream to produce separate hydrogen and reformate streams; separating the reformate stream into a gasoline pool stream, an aromatics stream, and an aromatic bottoms stream; and hydrodearylating heavy, non-condensed, alkyl-bridged, multi-aromatic compounds from the aromatic bottoms stream by hydrogenating and hydrocracking the heavy, non-condensed, alkyl-bridged, multi-aromatic compounds to produce a stream suitable for recycle to the reforming step or the reformate stream, where the hydrodearylating step uses hydrogen from the hydrogen stream.

In some embodiments of the method, the hydrodearylating step is carried out in a hydrogenation unit and a light hydrocracking unit, and the hydrogenation unit is operable to receive hydrogen produced in the reforming step. Still in other embodiments the method includes a fractionating step before the hydrodearylating step, the fractionating step operable to separate the heavy, non-condensed, alkyl-bridged, multi-aromatic compounds from the aromatic bottoms stream from compounds with a boiling point of about 180° C. or less. In certain embodiments, the fractionating step comprises the use of an atmospheric distillation unit. Still in other embodiments, the aromatic bottoms stream comprises aromatic compounds with boiling points in a range of about 100° C. to about 450° C. In certain other embodiments, the stream suitable for recycle to the reforming step or the reformate stream comprises at least one component selected from the group consisting of: mono-aromatics; naphthenic mono-aromatics; mono-naphthenics; di-naphthenics; paraffins; naphthenic di-aromatics; di-aromatics; tri-/tetra-aromatics; and combinations of the same.

Still in other embodiments of the method, the mono-aromatics comprise benzene, toluene, xylenes, and ethyl benzene. In certain embodiments, the hydrodearylating step produces a gas stream separate from the stream suitable for recycle to the reforming step or the reformate stream, the gas stream comprising at least one component selected from the group consisting of: fuel gas, liquefied petroleum gas, ethylene, propylene, butylene, and combinations of the same. Still in other embodiments, the hydrodearylating step comprises use of a dual catalyst hydrodearylation unit comprising at least 2 different catalysts. In certain embodiments, at least one of the hydrogenation unit and light hydrocracking unit include a catalyst selected from the group consisting of: a noble metal, a non-noble metal, a zeolite, and a solid acid catalyst. Still in other embodiments of the method, the hydrogenation unit includes a catalyst comprising platinum and the light hydrocracking unit includes a catalyst comprising ZSM-5 zeolite with an alumina-only binder and no active phase metals. In some embodiments, the hydrogenation unit and light hydrocracking unit use different catalysts. Still in other embodiments, the heavy, non-condensed, alkyl-bridged, multi-aromatic compounds from the aromatic bottoms stream comprise at least two benzene rings connected by an alkyl bridge group having at least two carbons, and the benzene rings are connected to different carbons of the alkyl bridge group.

In certain embodiments of the method, the hydrodearylating step is operable at pressures between about 10 bar and about 100 bar. In other embodiments, the hydrodearylating step is operable at pressures between about 15 bar and about 70 bar. Still in other embodiments, the hydrodearylating step is operable at temperatures between about 150° C. and about 450° C. In yet other embodiments, the hydrodearylating step is operable at temperatures between about 200° C. and about 400° C. In still other embodiments, the hydrodearylating step produces a bleed stream containing naphthenes and aromatics to be directed towards fuel pools suitable for diesel and jet fuel.

In certain embodiments of the method, benzene content of the gasoline pool stream is less than about 3% by volume. In other embodiments, benzene content of the gasoline pool stream is less than about 1% by volume. Still in other embodiments, the method includes the step of recycling a portion of the stream suitable for recycle to the reforming step or the reformate stream to the atmospheric distillation unit. In certain other embodiments, the method further comprises the use of a reactor type, for example in the step of hydrodearylating, selected from the group consisting of: a fixed-bed reactor, a slurry-bed reactor, an ebullated bed reactor, a continuously-stirred tank reactor, a moving-bed reactor, and combinations of the same.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems and methods for catalytic hydrodearylation and aromatics recovery, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1A:
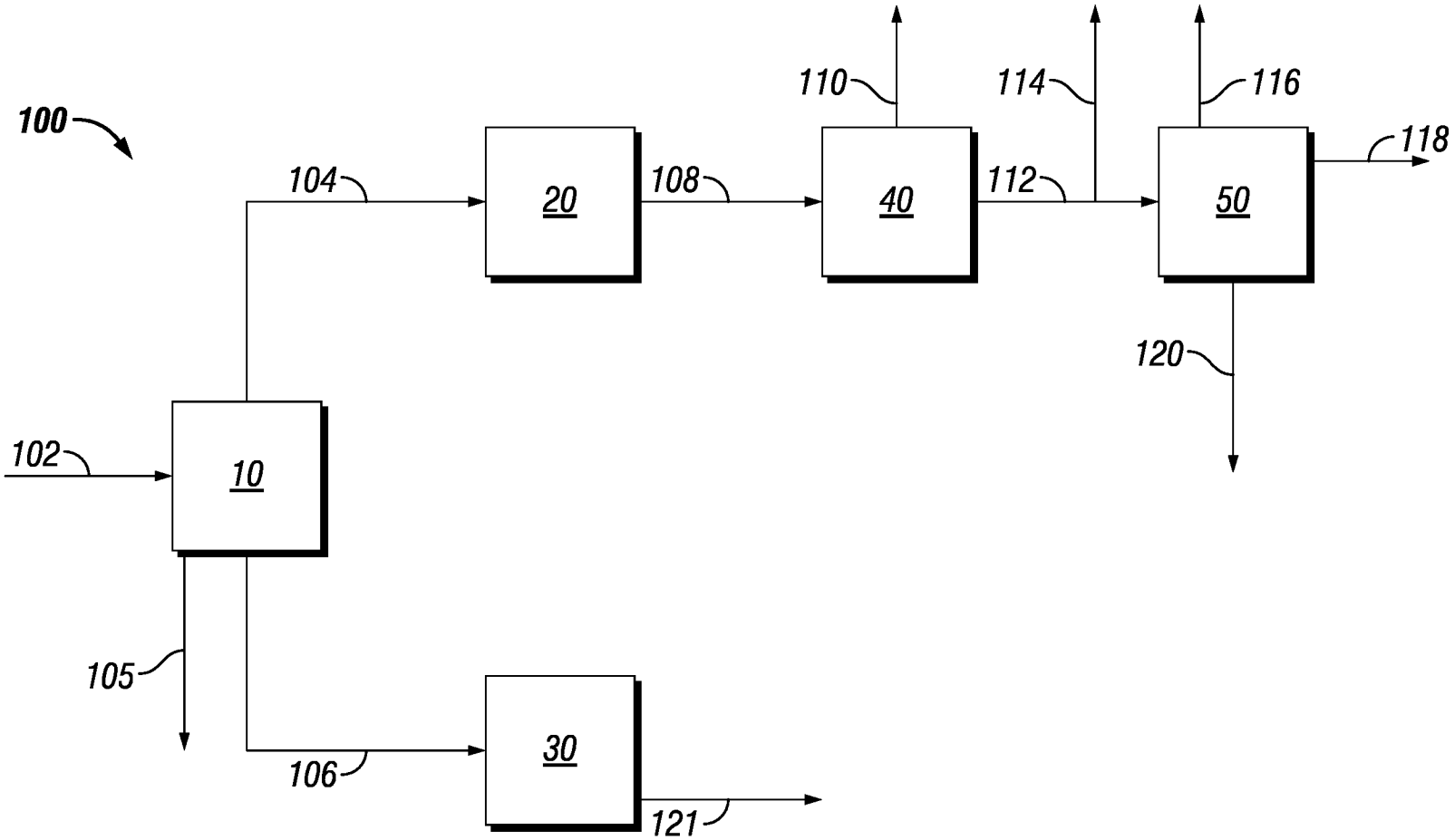
FIG. 1A (Prior Art)
FIG. 1A is a schematic of a conventional system for gasoline and aromatic production.

Referring first to FIG. 1A, a schematic of a conventional system for gasoline and aromatic production is shown. In the embodiment of FIG. 1A, a refinery with an aromatic complex is presented. In refining system 100, a crude oil inlet stream 102 is fluidly coupled to atmospheric distillation unit (ADU) 10, and crude oil from the crude oil inlet stream 102 is separated into naphtha stream 104, atmospheric residue stream 105, and diesel stream 106. Diesel stream 106 proceeds to diesel hydrotreating unit (DHT) 30, and naphtha stream 104 proceeds to naphtha hydrotreating unit (NHT) 20. A hydrotreated naphtha stream 108 exits NHT 20 and enters catalytic naphtha reforming unit (NREF) 40. A separated hydrogen stream 110 exits NREF 40, and a reformate stream 112 also exits NREF 40. A portion of reformate stream 112 enters aromatic complex (ARC) 50, and another portion of reformate stream 112 is separated by gasoline pool stream 114 to a gasoline pool. ARC 50 separates the reformate stream 112 into gasoline pool stream 116, aromatics stream 118, and aromatic bottoms 120.

The hydrotreated naphtha stream is reformed in a reforming unit to produce a gasoline reformate product stream. In general, the operating conditions for a reforming unit include a temperature in the range of from about 260° C. to about 560° C., and in certain embodiments from about 450° C. to about 560° C.; a pressure in the range of from about 1 bar to about 50 bars, and in certain embodiments from about 1 bar to about 20 bars; and a LHSV in the range of from about 0.5 $h^{-1}$ to about 40 $h^{-1}$, and in certain embodiments from about 0.5 $h^{-1}$ to about 2 $h^{-1}$. The reformate is sent to the gasoline pool to be blended with other gasoline components to meet the required specifications.

The crude oil is distilled in ADU 10 to recover naphtha, which boils in the range of about 36° C. to about 180° C., and diesel, which boils in the range of about 180° C. to about 370° C. An atmospheric residue fraction in atmospheric residue stream 105 boils at about 370° C. and greater. Naphtha stream 104 is hydrotreated in NHT 20 to reduce the sulfur and nitrogen content to less than about 0.5 ppmw, and the hydrotreated naphtha stream 108 is sent to NREF 40 to improve its quality, or in other words increase the octane number to produce gasoline blending stream or feedstock for an aromatics recovery unit. Diesel stream 106 is hydrotreated in DHT 30 to desulfurize the diesel oil to obtain a diesel fraction meeting stringent specifications at ultra-low sulfur diesel (ULSD) stream 121, such as, for example, less than 10 ppm sulfur. An atmospheric residue fraction is either used as a fuel oil component or sent to other separation or conversion units to convert lesser value hydrocarbons to products having greater value. Reformate stream 112 from NREF 40 can be used as a gasoline blending component or sent to an aromatic complex, such as ARC 50, to recover valuable aromatics, such as benzene, toluene and xylenes.

Figure 1B:
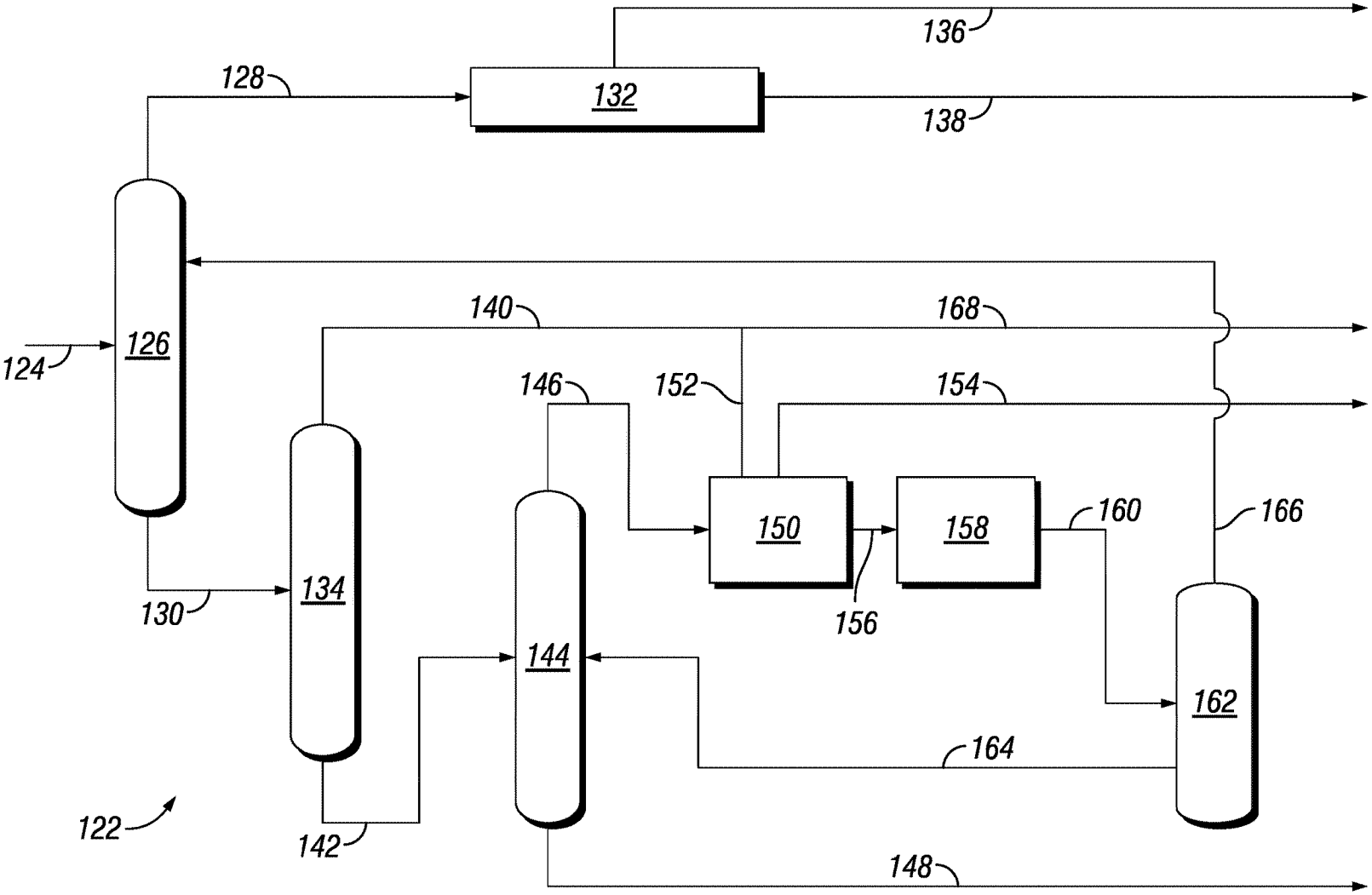
FIG. 1B (Prior Art)
FIG. 1B is a schematic of a conventional aromatics separation and recovery complex.

Referring now to FIG. 1B, a schematic of a prior art aromatics separation complex 122, such as, for example, ARC 50 of FIG. 1, is shown. Reformate stream 124 from a catalytic reforming unit, such as, for example, NREF 40 of FIG. 1, is split into two fractions: light reformate stream 128 with $C_5$-$C_6$ hydrocarbons, and heavy reformate stream 130 with $C_{7+}$ hydrocarbons. A reformate splitter 126 separates reformate stream 124. The light reformate stream 128 is sent to a benzene extraction unit 132 to extract the benzene as benzene product in stream 138, and to recover substantially benzene-free gasoline in raffinate motor gasoline (mogas) stream 136. The heavy reformate stream 130 is sent to a splitter 134 which produces a $C_7$ cut mogas stream 140 and a $C_{8+}$ hydrocarbon stream 142.

Still referring to FIG. 1B, a xylene rerun unit 144 separates $C_{8+}$ hydrocarbons into $C_8$ hydrocarbon stream 146 and $C_{9+}$ (heavy aromatic mogas) hydrocarbon stream 148. $C_8$ hydrocarbon stream 146 proceeds to p-xylene extraction unit 150 to recover p-xylene in p-xylene product stream 154. P-xylene extraction unit 150 also produces a $C_7$ cut mogas stream 152, which combines with $C_7$ cut mogas stream 140 to produce $C_7$ cut mogas stream 168. Other xylenes are recovered and sent to xylene isomerization unit 158 by stream 156 to convert them to p-xylene. The isomerized xylenes are sent to splitter column 162. The converted fraction is recycled back to p-xylene extraction unit 150 from splitter column 162 by way of streams 164 and 146. Splitter top stream 166 is recycled back to reformate splitter 126. The heavy fraction from the xylene rerun unit 144 is recovered as process reject or aromatic bottoms (shown as $C_{9+}$ and Hvy Aro MoGas in FIG. 1B at stream 148). Stream 148 in FIG. 1B (similar to aromatic bottoms 120 in FIG. 1) can comprise heavy, non-condensed multi-aromatics such as di-aromatics.

Figure 2A:
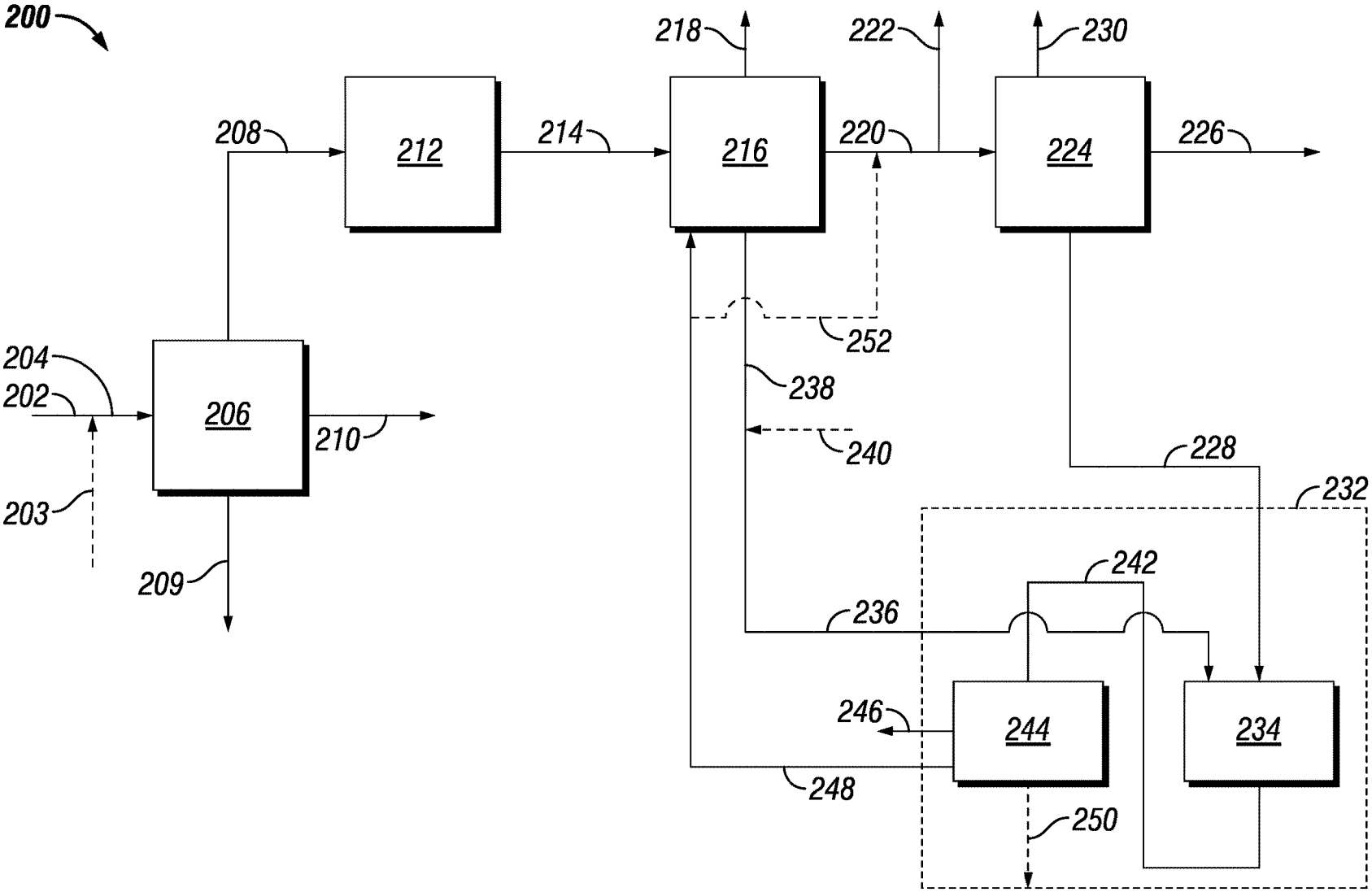
FIG. 2A is a schematic showing two-stage hydrodearylation of an aromatic bottoms stream for gasoline blending component and BTX production.

Referring now to FIG. 2A, a schematic is provided showing two-stage hydrodearylation of an aromatic bottoms stream (for example, stream 148 of FIG. 1B) for gasoline blending component and BTX production. In crude oil separation and upgrading system 200, crude oil stream 202 is optionally combined with a hydrocarbon recycle stream 203 to form hydrocarbon feed stream 204, which feeds ADU 206. ADU 206 separates hydrocarbons from hydrocarbon feed stream 204 into naphtha stream 208, atmospheric residue stream 209, and diesel stream 210. Diesel stream 210 can be fed to a DHT (not pictured) for processing to produce ULSD. Naphtha stream 208 is fed to NHT 212 for processing. A hydrotreated naphtha stream 214 is fed to NREF 216. NREF 216 produces a hydrogen stream 218 and a reformate stream 220. A portion of reformate stream 220 proceeds to a gasoline pool by way of stream 222, and a portion of reformate stream 220 is fed to ARC 224. ARC 224 produces aromatics, for example, benzene and xylenes, at stream 226 and aromatic bottoms at stream 228. A portion of hydrocarbons from ARC 224 proceed to the gasoline pool by way of stream 230.

As described herein, the term "aromatics" includes $C_6$-$C_8$ aromatics, such as, for example, benzene and xylenes, for example, streams 138, 154 in FIG. 1B, whereas "aromatic bottoms" include the heavier fraction, for example, stream 148 in FIG. 1B ($C_{9+}$). Aromatic bottoms relate to $C_{9+}$ aromatics and may be a more complex mixture of compounds including di-aromatics, both condensed and non-condensed. $C_{9+}$ aromatics boil in the range of about 100° C. to about 350° C.

Figure 2B:
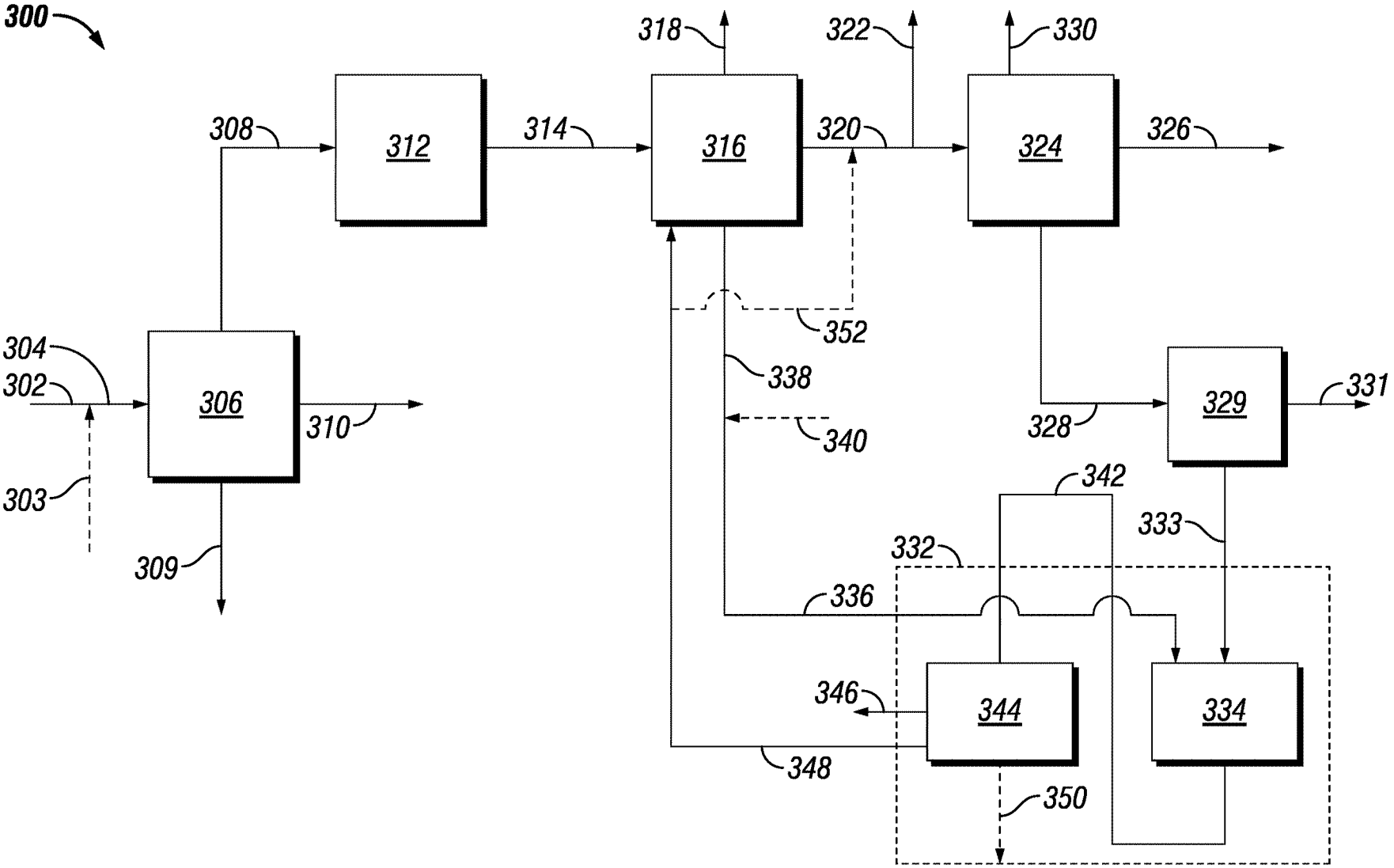
FIG. 2B is a schematic showing two-stage hydrodearylation of an aromatic bottoms stream, first fractionated, for gasoline blending component and BTX production.

Aromatic bottoms produced at stream 228 proceed to a two-stage hydrodearylation unit 232. In a hydrogenation unit 234, the aromatic bottoms are first combined with hydrogen from stream 236. Hydrogen in stream 236 can be supplied from NREF 216 via stream 238 in addition to or alternative to fresh hydrogen from make-up stream 240. The hydrogenated aromatic bottoms proceed via line 242 to a second stage for light hydrocracking in light hydrocracking unit 244. Light hydrocracking unit 244 produces a gas phase product stream 246, a two-stage hydrodearylated bottoms stream 248, and an optional bleed stream 250. Two-stage hydrodearylated bottoms stream 248 can be recycled to NREF 216, or all of two-stage hydrodearylated bottoms stream 248 or a portion of two-stage hydrodearylated bottoms stream 248 can be sent to be combined with reformate stream 220 via stream 252. In the embodiments of FIGS. 2A and 2B, the respective hydrogenation and light hydrocracking units are represented as separate units; however, in certain embodiments both hydrogenation and light hydrocracking of a heavy aromatic bottoms stream can occur in a single unit in different zones, for example, a single unit with different zones having different catalysts and reaction conditions for light hydrocracking and hydrogenation.

FIG. 2B is a schematic showing two-stage hydrodearylation of an aromatic bottoms stream, first fractionated, for gasoline blending component and BTX production. In crude oil separation and upgrading system 300, crude oil stream 302 is optionally combined with a hydrocarbon recycle stream 303 to form hydrocarbon feed stream 304, which feeds ADU 306. ADU 306 separates hydrocarbons from hydrocarbon feed stream 304 into naphtha stream 308, atmospheric residue stream 309, and diesel stream 310. Diesel stream 310 can be fed to a DHT (not pictured) for processing to produce ULSD. Naphtha stream 308 is fed to NHT 312 for processing. A hydrotreated naphtha stream 314 is fed to NREF 316. NREF 316 produces a hydrogen stream 318 and a reformate stream 320. A portion of reformate stream 320 proceeds to a gasoline pool by way of stream 322, and a portion of reformate stream 320 is fed to ARC 324. ARC 324 produces aromatics, for example, benzene and xylenes, at stream 326 and aromatic bottoms at stream 328. A portion of hydrocarbons from ARC 324 goes to the gasoline pool by way of stream 330.

As described herein, the term "aromatics" includes $C_6$-$C_8$ aromatics, such as, for example, benzene and xylenes, for example, streams 138, 154 in FIG. 1B, whereas "aromatic bottoms" include the heavier fraction, for example, stream 148 in FIG. 1B ($C_{9+}$). Aromatic bottoms relate to $C_{9+}$ aromatics and may be a more complex mixture of compounds including di-aromatics, both condensed and non-condensed. $C_{9+}$ aromatics boil in the range of about 100° C. to about 350° C.

Aromatic bottoms produced at stream 328 proceed first to an atmospheric distillation unit (ADU) 329 (also referred to as a fractionator) prior to proceeding to a two-stage hydrodearylation unit 332. In ADU 329 aromatic bottoms are separated into different hydrocarbon components by boiling point. Those components boiling in the gasoline and naphtha range at about 180° C. and less are sent directly to a gasoline blending pool via stream 331, and the components boiling at about 180° C. and greater are sent to two-stage hydrodearylation unit 332, which includes hydrogenation and lesser pressure hydrocracking, along with dual catalyst use. The bottoms fraction boiling above the gasoline range, above about 180° C., requires treatment according to two-stage hydrodearylation unit 332. However, the aromatic bottoms fraction from ARC 324 does not necessarily have to be fractionated and can be treated directly in-line with the system and process represented by FIG. 2A.

In FIG. 2B, the heavy 180° C.+ fraction from ADU 329 is sent to two-stage hydrodearylation unit 332 for hydrogenation and light hydrocracking of the aromatic rings, with hydrodearylation also being undertaken, during which mono-naphthenes, paraffins, and BTX are produced. In a first hydrogenation unit 334, the aromatic bottoms are combined with hydrogen from stream 336. Hydrogen in stream 336 can be supplied from NREF 316 via stream 338 in addition to or alternative to fresh hydrogen from make-up stream 340. The hydrogenated aromatic bottoms proceed via line 342 to a second stage for light hydrocracking in light hydrocracking unit 344. Light hydrocracking unit 344 produces a gas phase product stream 346, a two-stage hydrodearylated bottoms stream 348, and an optional bleed stream 350. Two-stage hydrodearylated bottoms stream 348 can be recycled to NREF 316, or all of two-stage hydrodearylated bottoms stream 348 or a portion of two-stage hydrodearylated bottoms stream 348 can be sent to be combined with reformate stream 320 via stream 352.

Two-stage hydrodearylated bottoms stream 348, the product stream, is rich in naphthenes, paraffins, and mono-aromatics, and when recycled back to NREF 316 for dehydrogenation of de-alkylated rings, this produces additional BTX and gasoline blending components. Any bottoms products containing naphthenes and aromatics in minor proportion in light hydrocracking unit 344 may be directed to a diesel, jet fuel, or kerosene pool as a blending component via stream 350. In some embodiments, not pictured, a final two-stage hydrodearylated product stream, such as two-stage hydrodearylated bottoms stream 348, is recycled back to a fractionator unit downstream of the aromatics complex, such as ADU 329, for further processing and a greater conversion of the aromatic bottoms products.

Figure 3A:
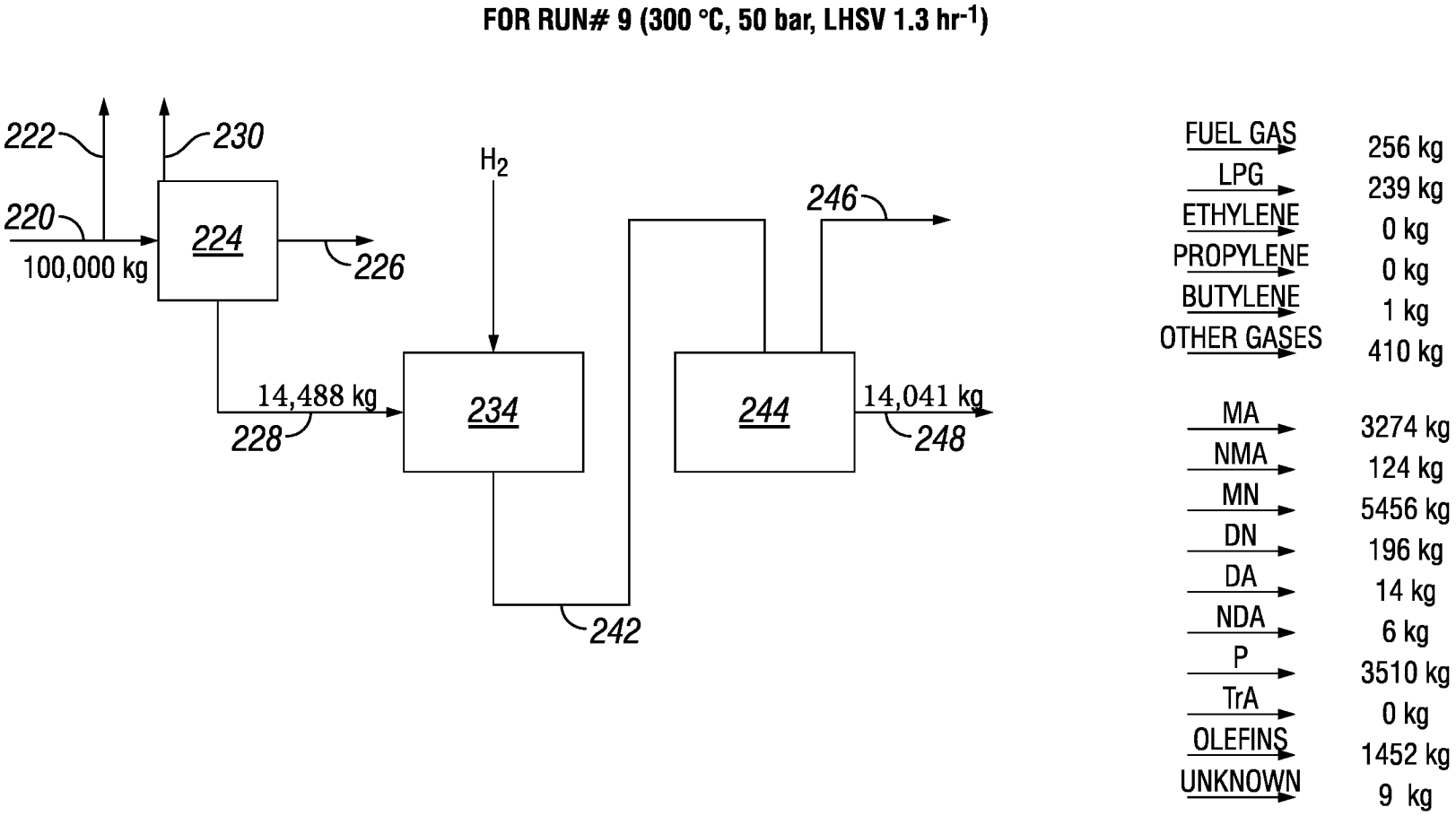
FIGS. 3A-3C show schematics with material balances for certain example two-stage hydrodearylation processes.
Figure 3B:
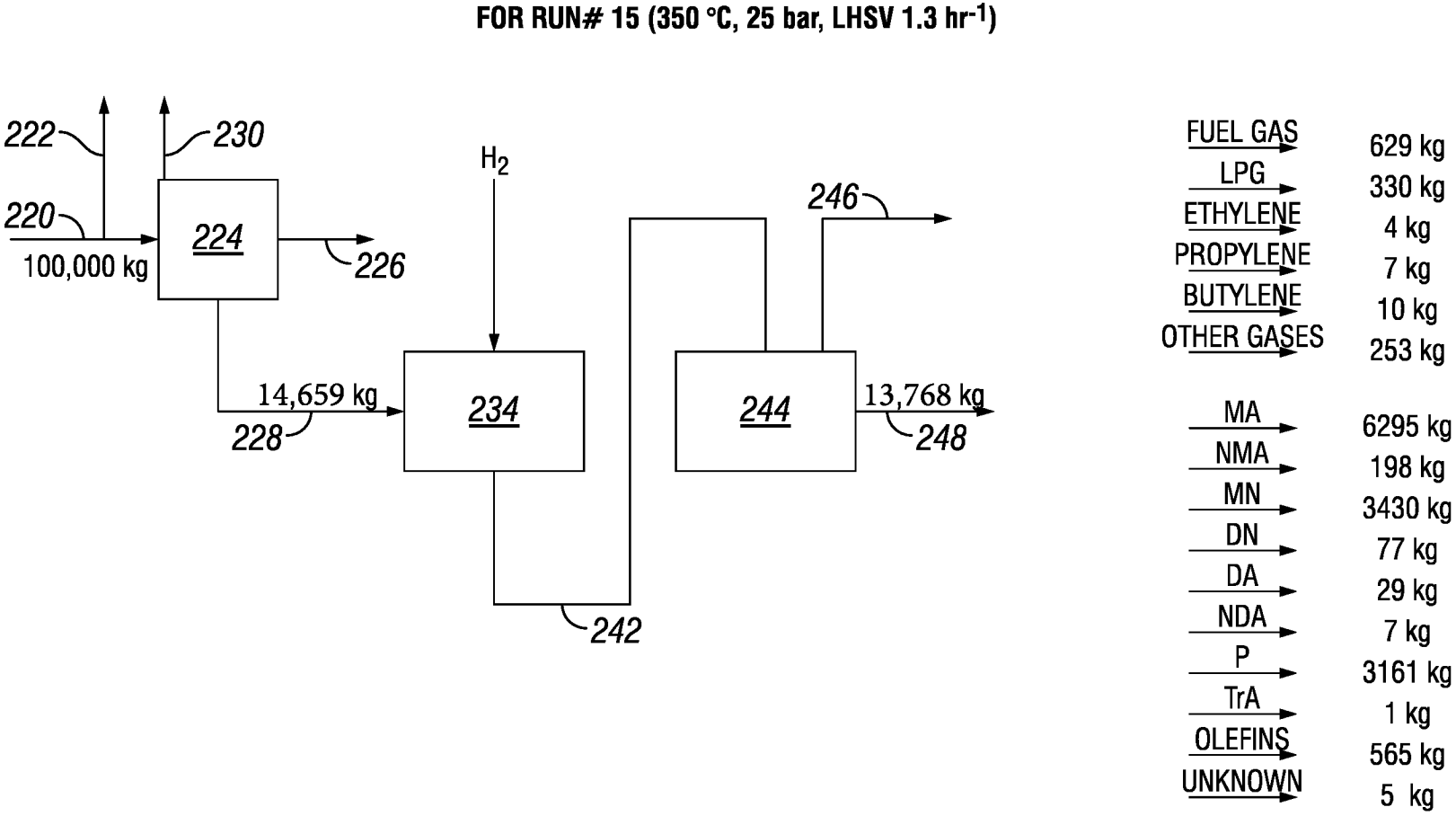
Figure 3C:
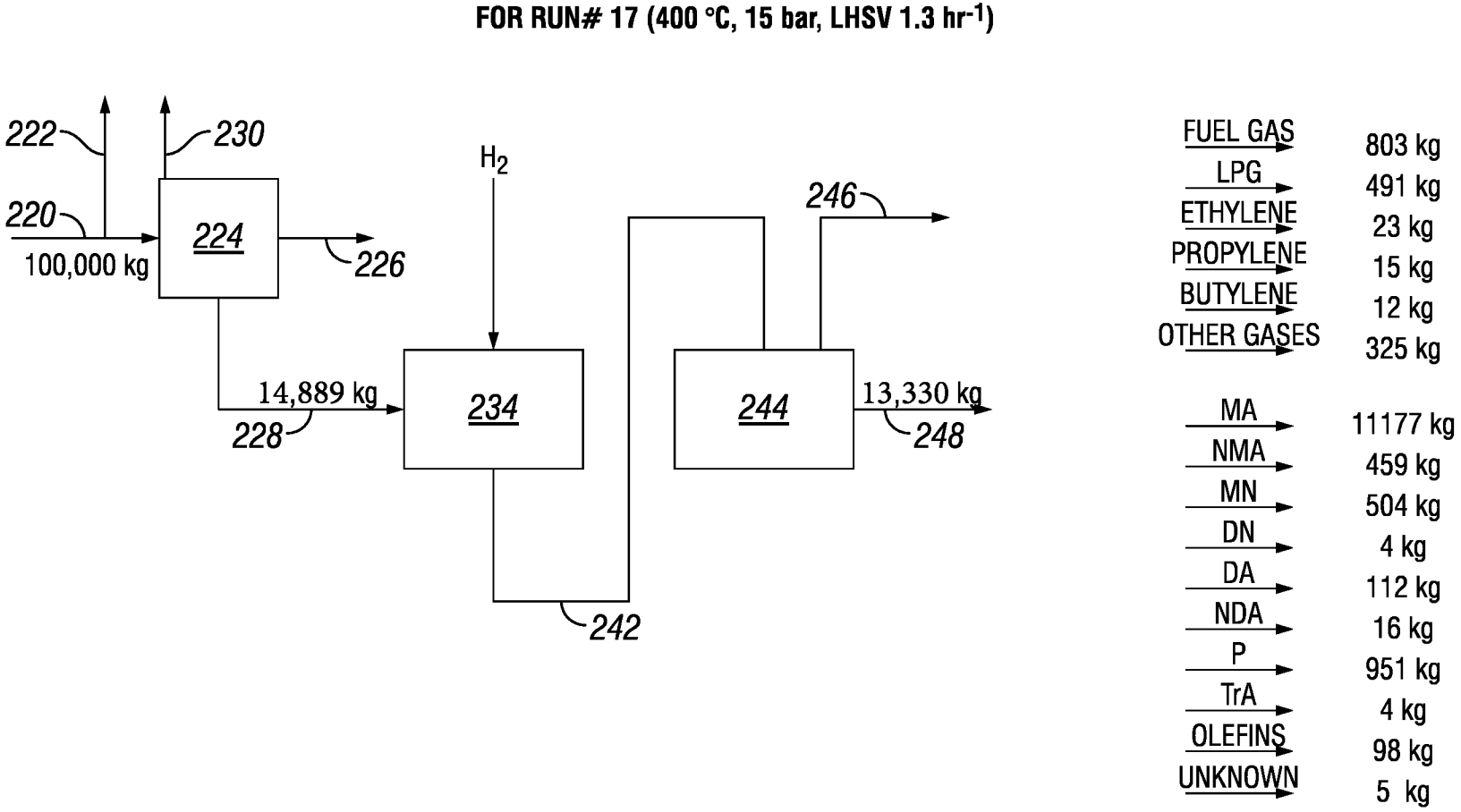

FIGS. 3A-3C show schematics with material balances for certain example two-stage hydrodearylation processes. In FIGS. 3A-3C, the following abbreviations apply: MA=mono-aromatics; NMA=naphthenic mono-aromatics; MN=mono-naphthenics; DN=di-naphthenics; P=paraffins; NDA=naphthenic di-aromatics; DA=di-aromatics; TrA=tri-/tetra-aromatics. Similarly labeled units and streams are the same as those in previous figures.

EXAMPLES

In Example 1, 11.4775 kg of an aromatic bottoms fraction was distilled using a lab scale true boiling point distillation column with 15 or more theoretical plates using ASTM method D2917. 9.411 kg (82 W %) of a gasoline fraction boiling in the range of 36° C. to 180° C. was obtained, and 2.066 Kg (18 W %) of a residue stream boiling above 180° C. was obtained. The gasoline fraction was analyzed for its content and octane numbers.

TABLE 1

Properties of aromatic bottoms feed stream of Example 1.

| Property | Unit | Feedstock Aromatic Bottoms | Tops Gasoline IBP 180° C.− | Bottoms Diesel 180° C.+ |
|---|---|---|---|---|
| Density | g/cc | 0.8838 | 0.8762 | 0.9181 |
| Octane Number ASTM D2799 | — | NA | 110 | NA |
| Cetane Index | — | NA | NA | 12 |
| IBP | ° C. | 153 | 67 | 167 |
| 5 W % | ° C. | 162 | 73 | 176 |
| 10 W % | ° C. | 163 | 73 | 181 |
| 30 W % | ° C. | 167 | 76 | 192 |
| 50 W % | ° C. | 172 | 77 | 199 |
| 70 W % | ° C. | 176 | 79 | 209 |
| 90 W % | ° C. | 191 | 81 | 317 |
| 95 W % | ° C. | 207 | 81 | 333 |
| FBP | ° C. | 333 | 83 | 422 |
| Paraffins | wt. % | 0.00 | n/a | n/a |
| Mono-aromatics | wt. % | 94.1 | n/a | n/a |
| Naphtheno Mono-aromatics | wt. % | 0.9 | n/a | n/a |
| Di-aromatics | wt. % | 3.7 | n/a | n/a |
| Naphtheno di-aromatics | wt. % | 0.9 | n/a | n/a |
| Tri+ Aromatics | wt. % | 0.3 | n/a | n/a |

n/a = not applicable

In Example 2, a non-fractionated aromatic bottoms stream was contacted with a commercially available Pt-containing hydrogenation catalyst, and a hydrocracking catalyst (H-ZSM-5 (MFI structure), SAR=23, 29 wt. % zeolite, 71 wt. % alumina-only binder) with no active phase metals in a pilot plant under the conditions as given in Table 2.

TABLE 2

Aromatic bottoms two-stage hydrodearylation (hydrogenation and light hydrocracking) conditions.

| Run # | Temperature ° C. | Pressure Bar | LHSV $hr^{-1}$ |
|---|---|---|---|
| 1 | 200 | 15 | 1.3 |
| 2 | 200 | 25 | 1.3 |
| 3 | 250 | 25 | 1.3 |
| 4 | 250 | 15 | 1.3 |
| 5 | 250 | 6 | 1.3 |
| 6 | 300 | 15 | 1.3 |
| 7 | 300 | 25 | 1.3 |
| 8 | 300 | 30 | 1.3 |
| 9 | 300 | 50 | 1.3 |
| 10 | 300 | 60 | 1.3 |
| 11 | 300 | 70 | 1.3 |
| 12 | 300 | 80 | 1.3 |
| 13 | 300 | 90 | 1.3 |
| 14 | 300 | 100 | 1.3 |
| 15 | 350 | 25 | 1.3 |
| 16 | 350 | 15 | 1.3 |
| 17 | 400 | 15 | 1.3 |
| 18 | 400 | 25 | 1.3 |

In this example, there was one reactor having the two different catalysts (for hydrogenation and light hydrocracking) stacked. However, in other embodiments there can be two separate reactors, each having its own catalyst type (for example, FIG. 2A). Separate reactors can operate at individual temperatures and pressures to provide more flexibility in product compositions. Suitable reactor types include a fixed-bed reactor, a slurry-bed reactor, an ebullated bed reactor, a continuously-stirred tank reactor, a moving-bed reactor, and combinations of the same.

The hydrogenation catalyst performs hydrodearylation and also hydrogenates di-aromatics to mono-naphthenic aromatics. Hydrogenation of mono-aromatics to naphthenes can also take place. One targeted reaction is hydrogenation of a single ring in condensed di-aromatics to single mono-aromatics containing a naphthenic ring. Then, a lesser-pressure hydrocracking catalyst can open the naphthenic ring of the mono-naphthenic aromatics to yield, for example, mono-aromatics and paraffins.

Feed and product compositions were analyzed by gas chromatography (GC), as well as 2D-GC, and certain results are shown in FIGS. 3A-3C. A substantial conversion of aromatics into paraffins and naphthenes can be observed showing the advantageous extent of the two-stage hydrodearylation process. Additionally, non-condensed and condensed di-aromatic content is reduced with hydrodearylation of the alkyl-bridged, non-condensed, di-aromatics resulting in mono-aromatics and mono-naphthenes. Increased levels of BTX are also obtained. The products can be recycled back as gasoline blending components to improve gasoline volume and quality. Further breakdown of the liquid product mono-aromatic species showed xylene and ethyl benzene formation, with a greater selectivity for $C_8$ mono-aromatics than for toluene and benzene.

When subjecting the aromatic bottoms stream to the two-stage hydrodearylation (hydrogenation/light hydrocracking) process in Run 5, for example, there is benzene, toluene and $C_8$ production of 8 kg (about 0.1 wt. % of the aromatic bottoms stream), 21 kg (about 0.1 wt. % of the aromatic bottoms stream), and 129 kg (about 0.9 wt. % of the aromatic bottoms stream), respectively.

Changing the operating conditions results in the hydrogenated/hydrocracked product stream yielding benzene, toluene, and $C_8$ production of: 0 kg, 13 kg, and 1,115 kg (about 7.8 wt. % of the aromatic bottoms reject stream), respectively, for Run 9 (FIG. 3A). In Run 9, about 513 kg of $H_2$ was added to hydrogenation unit 234, which as noted previously can be supplied from a NREF or from fresh make-up hydrogen.

For Run 15 (FIG. 3B) the operating conditions result in the hydrogenated/hydrocracked product stream yielding benzene, toluene, and $C_8$ production of: 50 kg (about 0.3 wt. % of the aromatic bottoms stream), 222 kg (about 1.5 wt. % of the aromatic bottoms stream), and 847 kg (about 5.8 wt. % of the aromatic bottoms stream), respectively. In Run 15, about 342 kg of $H_2$ was added to hydrogenation unit 234.

For Run 17 (FIG. 3C) the operating conditions result in the hydrogenated/hydrocracked product stream yielding benzene, toluene, and $C_8$ production of: 112 kg (about 0.7 wt. % of the aromatic bottoms stream), 1065 kg (about 7.2 wt. % of the aromatic bottoms stream), and 1489 kg (about 10.0 wt. % of the aromatic bottoms stream), respectively. In Run 17, about 110 kg of $H_2$ was added to hydrogenation unit 234. As shown, less hydrogen is required at increasing temperature and decreasing pressure.

Two-stage hydrodearylation with hydrogenation and lesser-pressure hydrocracking allows for processing of heavy aromatics streams with a dual catalyst system, and hydrodearylation is effected on alkyl-bridged di-aromatics. Products can be recycled back to a reformate unit to dehydrogenate naphthenes, to improve gasoline volume and quality, and also to increase BTX production. Suitable aromatic bottoms streams can be those comprising aromatic compounds with boiling points in a range of about 100° C. to about 450° C. In some embodiments, benzene content of gasoline pool streams is less than about 3% by volume. In some embodiments, benzene content of gasoline pool streams is less than about 1% by volume.

In certain embodiments of the systems and methods, an aromatic bottoms stream comprises greater than about 50 wt. % or greater than about 70 wt. % single-ring aromatics having alkyl groups containing three or more carbon atoms. In some embodiments, an aromatics bottom stream has between about 20 wt. % to about 95 wt. % single-ring aromatics having alkyl groups containing three or more carbon atoms. In some embodiments, the hydrogenation catalyst includes one or more noble metal catalyst. The noble metal catalyst can include Pt or Pd or a mixture thereof. In some embodiments, hydrogenation and/or light hydrocracking catalysts include at least one zeolite. The zeolite can include, for example, a USY framework or modified USY framework.

In some embodiments, the framework of modified USY contains Ti, Zr, or Hf or a mixture thereof. In some embodiments, a catalyst support includes alumina, silica-alumina, titania or a combination thereof. Zeolite content of a catalyst for use can be between about 1 wt. % to about 80 wt. %.

In some embodiments, the light hydrocracking catalyst includes a solid acid catalyst. The light hydrocracking catalyst can include an amorphous or crystalline catalyst. The solid acid catalyst can include a Lewis acid, a Brønsted acid, or a mixture thereof. The light hydrocracking catalyst can include a zeolite. The light hydrocracking catalyst can include a zeolite of structure MFI, FAU, MOR, BEA, or combinations thereof. The light hydrocracking catalyst support can include alumina, silica-alumina, titania, or combination thereof. The light hydrocracking catalyst weight percent of zeolite can be between about 1 wt. % to about 80 wt. %.

In some embodiments, active phase metals can be used and include Ni, Mo, W, or mixtures thereof. Active phase metals are applied as catalysts for hydrogenation of aromatic molecules. They are useful components of hydrocracking catalysts. In addition to hydrogenation, they enhance hydrogen transfer reactions. In the Examples described here, active phase metals were not applied, because cracking naphthenes with an acidic support was desired, however, in other embodiments active phase metals can be used.

In some embodiments here, alkyl-bridged, non-condensed, alkyl multi-aromatic compounds for hydrodearylation include at least two benzene rings connected by an alkyl bridge group having at least two carbons, and the benzene rings are connected to different carbons of the alkyl bridge group. In some embodiments, hydrodearylation generates mono-aromatics in addition to or alternative to mono-naphthenes.

In some embodiments, an aromatic bottoms stream is hydrogenated/hydrocracked to form naphthenes and/or naphtheno-aromatics and/or paraffins. In other embodiments, the aromatic bottoms stream is contacted with a hydrogenation and light hydrocracking dual catalyst, and is subjected to pressures of about 10 bar to about 100 bar, preferably about 15 bar to about 70 bar. Different catalysts can be in separate hydrogenation/light hydrocracking units (shown in FIGS. 2A, 2B), which provides unique temperature and pressure control of the separate units, but in other embodiments separate catalysts can be layered in one common unit for both hydrogenation and light hydrocracking (not pictured). In some embodiments, the pressure of a light hydrocracking unit is less than the pressure of a hydrogenation unit.

In some embodiments, the aromatic bottoms stream is contacted with the hydrogenation and/or hydrocracking dual catalyst (different catalysts in 2 separate units) and is subjected to temperatures of between about 150° C. to about 450° C., preferably about 200° C. to about 400° C. Hydrogenation reactions are thermodynamically controlled and are favorable at lesser temperatures than hydrocracking, and hydrogenation also is a function of the hydrogen partial pressures.

In some embodiments, a final two-stage hydrodearylated product stream is recycled back to a naphtha reforming unit (NREF). In some embodiments, a final two-stage hydrodearylated product stream is recycled back to a fractionator unit downstream of the aromatics complex. In some embodiments, a product stream is recycled back to the reformate stream, downstream of the NREF unit. In some embodiments, a bleed stream containing naphthenes in major proportions (more than about 50 wt. %, or more than about 70 wt. %, or preferably more than about 90 wt. %) in addition to or alternative to aromatics in minor proportions (less than about 50 wt. %, or less than about 70 wt. %, or preferably less than about 90 wt. %) from the product stream of hydrodearylation is directed towards fuel pools suitable for diesel or jet fuel. In some embodiments, a portion of a product stream comprises toluene ($C_7$) and mono-aromatics containing two additional carbon atoms (for example, $C_8$ xylenes and ethyl benzene).

The singular forms "a," "an," and "the" include plural referents, unless the context clearly dictates otherwise. The term "about" when used with respect to a value or range refers to values including plus and minus 5% of the given value or range.

One of ordinary skill in the art will understand that standard components such as pumps, compressors, temperature and pressure sensors, valves, and other components not shown in the drawings would be used in applications of the systems and methods of the present disclosure.

In the drawings and specification, there have been disclosed example embodiments of the present disclosure, and although specific terms are employed, the terms are used in a descriptive sense only and not for purposes of limitation. The embodiments of the present disclosure have been described in considerable detail with specific reference to these illustrated embodiments. It will be apparent, however, that various modifications and changes can be made within the spirit and scope of the disclosure as described in the foregoing specification, and such modifications and changes are to be considered equivalents and part of this disclosure.

The invention claimed is:

1. A system for oil separation and upgrading, the system comprising:

an inlet stream comprising crude oil;

an atmospheric distillation unit (ADU), the ADU in fluid communication with the inlet stream, and operable to separate the inlet stream into an ADU tops stream and an ADU middle stream, the ADU tops stream comprising naphtha, and the ADU middle stream comprising diesel;

a naphtha hydrotreating unit (NHT), the NHT in fluid communication with the ADU and operable to treat with hydrogen the naphtha in the ADU tops stream;

a naphtha reforming unit (NREF), the NREF in fluid communication with the NHT and operable to reform a hydrotreated naphtha stream produced by the NHT, and the NREF further operable to produce separate hydrogen and reformate streams;

an aromatics complex (ARC), the ARC in fluid communication with the NREF and operable to receive the reformate stream produced by the NREF, and the ARC further operable to separate the reformate stream into a gasoline pool stream, an aromatics stream, and an aromatic bottoms stream; and a hydrodearylation unit operable to receive heavy, non-condensed, alkyl-bridged, multi-aromatic compounds from the aromatic bottoms stream, the hydrodearylation unit further operable to hydrogenate and hydrocrack the heavy, non-condensed, alkyl-bridged, multi-aromatic compounds to produce a stream suitable for recycle to the NREF or the reformate stream, where the hydrodearylation unit is further operable to receive hydrogen produced in the NREF.

2. The system according to claim 1, where the hydrodearylation unit comprises a hydrogenation unit and a light hydrocracking unit, and where the hydrogenation unit is operable to receive hydrogen produced in the NREF.

3. The system according to claim 2, further comprising a fractionator fluidly disposed between the ARC and the hydrodearylation unit, the fractionator operable to separate the heavy, non-condensed, alkyl-bridged, multi-aromatic compounds from the aromatic bottoms stream from compounds with a boiling point of about 180° C. or less.

4. The system according to claim 3, where the fractionator comprises an atmospheric distillation unit.

5. The system according to claim 1, where the aromatic bottoms stream comprises aromatic compounds with boiling points in a range of about 100° C. to about 450° C.

6. The system according to claim 1, where the stream suitable for recycle to the NREF or the reformate stream comprises at least one component selected from the group consisting of: mono-aromatics; naphthenic mono-aromatics; mono-naphthenics; di-naphthenics; paraffins; naphthenic di-aromatics; di-aromatics; tri-/tetra-aromatics; and combinations of the same.

7. The system according to claim 6, where the mono-aromatics comprise benzene, toluene, xylenes, and ethyl benzene.

8. The system according to claim 1, where the hydrodearylation unit produces a gas stream separate from the stream suitable for recycle to the NREF or the reformate stream, the gas stream comprising at least one component selected from the group consisting of: fuel gas, liquefied petroleum gas, ethylene, propylene, butylene, and combinations of the same.

9. The system according to claim 1, where the hydrodearylation unit is a dual catalyst hydrodearylation unit comprising at least 2 different catalysts.

10. The system according to claim 2, where at least one of the hydrogenation unit and light hydrocracking unit include a catalyst selected from the group consisting of: a noble metal, a non-noble metal, a zeolite, and a solid acid catalyst.

11. The system according to claim 10, where the hydrogenation unit includes a catalyst comprising platinum and where the light hydrocracking unit includes a catalyst comprising ZSM-5 zeolite with an alumina-only binder and no active phase metals.

12. The system according to claim 10, where the hydrogenation unit and light hydrocracking unit use different catalysts.

13. The system according to claim 1, where the heavy, non-condensed, alkyl-bridged, multi-aromatic compounds from the aromatic bottoms stream comprise at least two benzene rings connected by an alkyl bridge group having at least two carbons, and the benzene rings are connected to different carbons of the alkyl bridge group.

14. The system according to claim 1, where the hydrodearylation unit is operable at pressures between about 10 bar and about 100 bar.

15. The system according to claim 1, where the hydrodearylation unit is operable at pressures between about 15 bar and about 70 bar.

16. The system according to claim 1, where the hydrodearylation unit is operable at temperatures between about 150° C. and about 450° C.

17. The system according to claim 1, where the hydrodearylation unit is operable at temperatures between about 200° C. and about 400° C.

18. The system according to claim 1, where the hydrodearylation unit produces a bleed stream containing naphthenes and aromatics to be directed towards fuel pools suitable for diesel and jet fuel.

19. The system according to claim 1, wherein benzene content of the gasoline pool stream is less than about 3% by volume.

20. The system according to claim 1, wherein benzene content of the gasoline pool stream is less than about 1% by volume.

21. The system according to claim 4, where a portion of the stream suitable for recycle to the NREF or the reformate stream is recycled to the fractionator.

* * * * *